US009680254B1

(12) United States Patent
Nishikata et al.

(10) Patent No.: US 9,680,254 B1
(45) Date of Patent: Jun. 13, 2017

(54) CONNECTOR AND CONNECTOR ASSEMBLY

(71) Applicant: JAPAN AVIATION ELECTRONICS INDUSTRY, LIMITED, Shibuya-ku, Tokyo (JP)

(72) Inventors: Masayuki Nishikata, Tokyo (JP); Masayuki Kikuchi, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 15/289,070

(22) Filed: Oct. 7, 2016

(30) Foreign Application Priority Data

Nov. 24, 2015 (JP) ..... 2015-228375

(51) Int. Cl.
*H01R 13/627* (2006.01)
*H01R 24/60* (2011.01)
*H01R 107/00* (2006.01)

(52) U.S. Cl.
CPC ..... *H01R 13/627* (2013.01); *H01R 24/60* (2013.01); *H01R 2107/00* (2013.01)

(58) Field of Classification Search
CPC ... H01R 13/6587; H01R 13/627; H01R 24/60
See application file for complete search history.

(56) References Cited

U.S. PATENT DOCUMENTS 7,758,379 B2 * 7/2010 Chen ..... H01R 13/6485 439/607.11
9,231,356 B1 * 1/2016 Ju ..... H01R 24/78
9,306,336 B2 * 4/2016 Chang ..... H01R 13/6471
2013/0330976 A1 12/2013 Simmel et al.
2015/0044886 A1 2/2015 Little et al.
2015/0126069 A1 5/2015 Little et al.
2015/0295362 A1 10/2015 Tziviskos et al.
(Continued)

FOREIGN PATENT DOCUMENTS

CN 203859322 U 10/2014
CN 204179385 U 2/2015
(Continued)

OTHER PUBLICATIONS

Extended European Search Report (in English) dated Apr. 13, 2017 issued in European counterpart Application No. 16192572.2.

*Primary Examiner* — Briggitte R Hammond
(74) *Attorney, Agent, or Firm* — Holtz, Holtz & Volek PC

(57) ABSTRACT

A connector includes a holding member which is formed with two accommodation portions, a middle portion and regulating portions. Flat plate portions which form a mid-plate are accommodated by the accommodation portions, respectively. Each of the flat plate portions has a base portion, a press-fit portion, a spring portion, a lock portion and a regulated portion. The press-fit portion protrudes from the base portion in a pitch direction and is pressed against the holding portion. The spring portion extends forward from the base portion and has resilience. The spring portion is apart from the regulating portion in the pitch direction. The lock portion is supported by the spring portion and protrudes outside the mating portion in the pitch direction. The regulated portion extends forward from the base portion and is situated inward of the regulating portions in the pitch direction.

8 Claims, 16 Drawing Sheets

(56) References Cited

U.S. PATENT DOCUMENTS

| | | | | |
|---|---|---|---|---|
| 2016/0056586 | A1* | 2/2016 | Guo | H01R 13/41<br>439/607.05 |
| 2016/0064866 | A1* | 3/2016 | Kao | H01R 13/6596<br>439/676 |
| 2016/0064869 | A1* | 3/2016 | Yu | H01R 24/60<br>439/607.05 |

FOREIGN PATENT DOCUMENTS

| | | | |
|---|---|---|---|
| CN | 204179389 | U | 2/2015 |
| JP | 2010073376 | A | 4/2010 |
| JP | 2011159507 | A | 8/2011 |
| JP | 3198301 | U | 6/2015 |

* cited by examiner

CONNECTOR AND CONNECTOR ASSEMBLY

CROSS REFERENCE TO RELATED APPLICATIONS

This application is based on and claims priority under 35 U.S.C. §119 to Japanese Patent Application No. JP2015-228375 filed Nov. 24, 2015, the contents of which are incorporated herein in their entirety by reference.

BACKGROUND OF THE INVENTION

This invention relates to a connector including a mid-plate and to a connector assembly.

A connector of this type is disclosed in CN 204179385 U (Patent Document 1). Referring to FIG. 25, the connector 900 disclosed in Patent Document 1 includes a frame (holding member) 910, first and second terminals 920 and 930, a grounding conductor 940 and a shield casing (shell) 950. Each of the first and the second terminals 920 and 930 has a plurality of contacts. The grounding conductor 940 is formed integrally with the frame 910 by means of insert molding.

As shown in FIG. 26, the grounding conductor 940 has a shielding plate (mid-plate) 942 and two flat plates (ground plates) 944. The shielding plate 942 is situated between the flat plates 944 in an up-down direction (Z-direction). The shielding plate 942 has an outline of a generally rectangular shape in a plan view. Furthermore, the shielding plate 942 has a pair of lock portions 946 which are provided outward thereof in a pitch direction (Y-direction) and is situated forward (at a part of a positive X-direction) thereof in a front-rear direction (X-direction). The lock portions 946 are protrusions protruding outward in the pitch direction (Y-direction). The lock portions 946 are formed to be unmovable in the pitch direction (Y-direction).

The lock portions 946 lock (frictionally lock) a mated state of the connector 900 and a mating connector (not shown) together with mating lock portions (not shown) when the connector 900 is mated with the mating connector. Repetition of mating and separating of the connector 900 and the mating connector brings abrasion in the lock portions 946. This is because the lock portions 946 are rubbed by the mating connector repeatedly. The lock portions 946 are formed to be unmovable. Accordingly, amounts of abrasion of the lock portions 946 are relatively large. Thus, the connector 900 of Patent Document 1 has a problem of low durability.

US 2013/0330976 A1 (Patent Document 2) discloses another connector which is provided with mid-plates. Referring to FIG. 27, an assembly 960 included in the connector (not shown) of Patent Document 2 has first and second sub-assemblies 970 and 980 and ground contacts (mid-plates) 990 which are situated between the first assemblies 970 and the second assemblies 980, respectively. Each of the ground contacts 990 is formed with a pair of spring portions 992. Each of the spring portions 992 is formed with a side ground contact (lock portion) 994 at a vicinity of a tip (an end portion of a positive X-direction) thereof. Owing to resilient deformation of the spring portion 992, the side ground contact 994 is movable in a pitch direction (Y-direction).

As shown in FIG. 27, the ground contact 990 is formed with openings 996. On the other hand, the second sub-assembly 980 is formed with posts 982 which correspond to the openings 996 of the ground contact 990. The second sub-assembly 980 is further formed with a passage 984. The ground contact 990 is combined with the second sub-assembly 980 by aligning the openings 996 with the posts 982. The first sub-assembly 970 is combined with the second assembly 980 by aligning through-hole portions 972 of contacts of the first sub-assembly 970 with the passage of the second assembly 980. Thus, the assembly 960 is assembled.

The side ground contacts 994 lock (frictionally lock) a mated state of the connector (not shown) and a mating connector (not shown) together with mating lock portions (not shown) when the connector is mated with the mating connector. The side ground contacts 994 are moved in the pitch direction (Y-direction) according to force given by the mating lock portions (not shown). Accordingly, frictional force between the side ground contacts 994 and the mating lock portions (not shown) is reduced. Thus, an amount of abrasion of the side ground contact 994 can be reduced in comparison with the amount of the abrasion of the lock portion 946 of Patent Document 1. In other words, the connector of Patent Document 2 has improved durability.

SUMMARY OF THE INVENTION

As described above, the connector 900 disclosed in Patent Document 1 has the problems of the large amount of the abrasion and the low durability because the lock portions 946 are unmovable. On the other hand, the connector disclosed in Patent Document 2 is superior to the connector of Patent Document 1 in durability. However, the connector of Patent Document 2 has a structure in which the ground contact 990 is sandwiched between the sub-assemblies 970 and 980 which are separated in an up-down direction (Z-direction). In the structure, assembly precision depends on production tolerances of the openings 996 of the ground contact 900, the posts 982 and the passage 984 of the second assembly 980. Accordingly, the connector of Patent Document 2 has a problem of low assembly precision.

It is an object of the present invention to provide a connector which has both of improved durability and improved assembly precision.

One aspect of the present invention provides a connector which is mateable with a mating connector along a front-rear direction. The mating connector comprises a mating lock portion. The connector comprises a plurality of contacts, a holding member and a mid-plate. The contacts form two contact rows. The contacts forming each of the contact rows are aligned in a pitch direction perpendicular to the front-rear direction. The contact rows are arranged apart from each other in an up-down direction perpendicular to both of the front-rear direction and the pitch direction. The holding member comprises a holding portion and a mating portion. The holding portion holds the contacts. The mating portion has a tongue-like shape and extends forward from the holding portion. The holding member is formed with two accommodation portions, a middle portion and regulating portions. The accommodation portions extend forward from a rear end of the holding member and open outward in the pitch direction at the mating portion. The middle portion is situated between the accommodation portions in the pitch direction. The regulating portions are formed in the mating portion. The mid-plate comprises two flat plate portions. The flat plate portions are accommodated by the accommodation portions, respectively, and the middle portion is sandwiched between the flat plate portions in the pitch direction. Each of the flat plate portions comprises a base portion, a press-fit portion, a spring portion, a lock portion and a regulated portion. The press-fit portion protrudes from the base portion in the pitch direction and is pressed against the holding portion. The spring portion extends forward from the base portion and has resilience. The spring portion is apart from the regulating portions in the pitch direction. The lock portion is supported by the spring portion and protrudes outward of the mating portion in the pitch direction. The regulated portion extends forward from the base portion and is situated inward of the regulating portions in the pitch direction. The lock portion and the mating lock portion lock a mated state of the connector and the mating connector.

Another aspect of the present invention provides a connector assembly which comprises the connector as mentioned above and the mating connector. The lock portion comprises a lock surface, a curved surface portion and a slide surface. The mating lock portion comprises a mating lock surface, a mating curved surface portion and a mating slide surface. The lock surface, the curved surface portion and the slide surface are continued in this order. The mating lock surface, the mating curved surface portion and the mating slide surface are continued in this order. The lock surface and the slide surface form an obtuse angle inside the lock portion. The mating lock surface and the mating slide surface form another obtuse angle inside the mating lock portion.

In the connector, the lock portion is supported by the spring portion. The spring portion has resilience. This structure can reduce abrasion of the lock portion and improve durability of the connector.

Furthermore, in the connector, the holding member has the accommodation portions extending forward from the rear end thereof. The flat plate portions, which form a mid-plate, are accommodated in the accommodation portions. The flat plate portions have press-fit portions. The press-fit portions are pressed against the holding portion under the state where the flat plate portions are accommodated in accommodation portions. This structure of the connector can reduce influence of production tolerance on assembly precision and improve the assembly precision.

An appreciation of the objectives of the present invention and a more complete understanding of its structure may be had by studying the following description of the preferred embodiment and by referring to the accompanying drawings.

Figure 1:
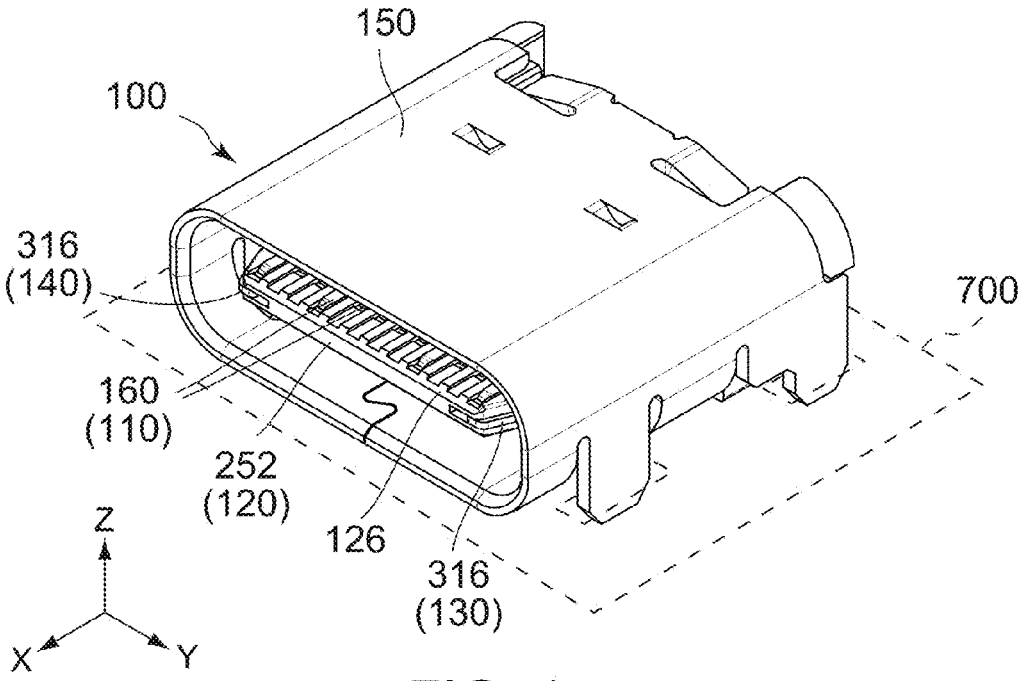
FIG. 1 is an upper perspective view showing a connector according to an embodiment of the present invention. In the figure, a circuit board on which the connector is mounted is shown by a broken line.
Figure 2:
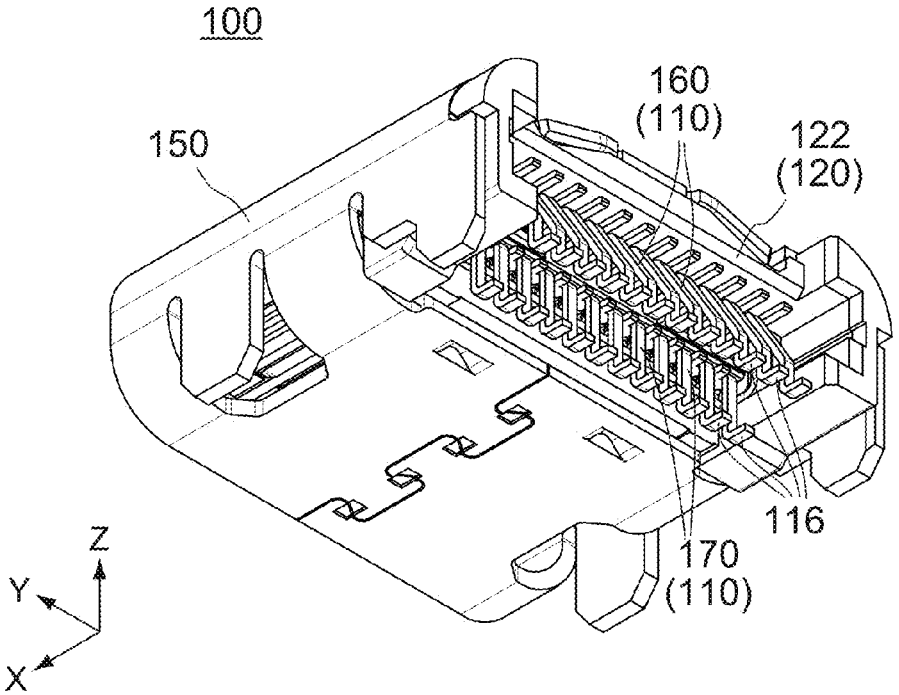
FIG. 2 is a lower perspective view showing the connector of FIG. 1.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 17:
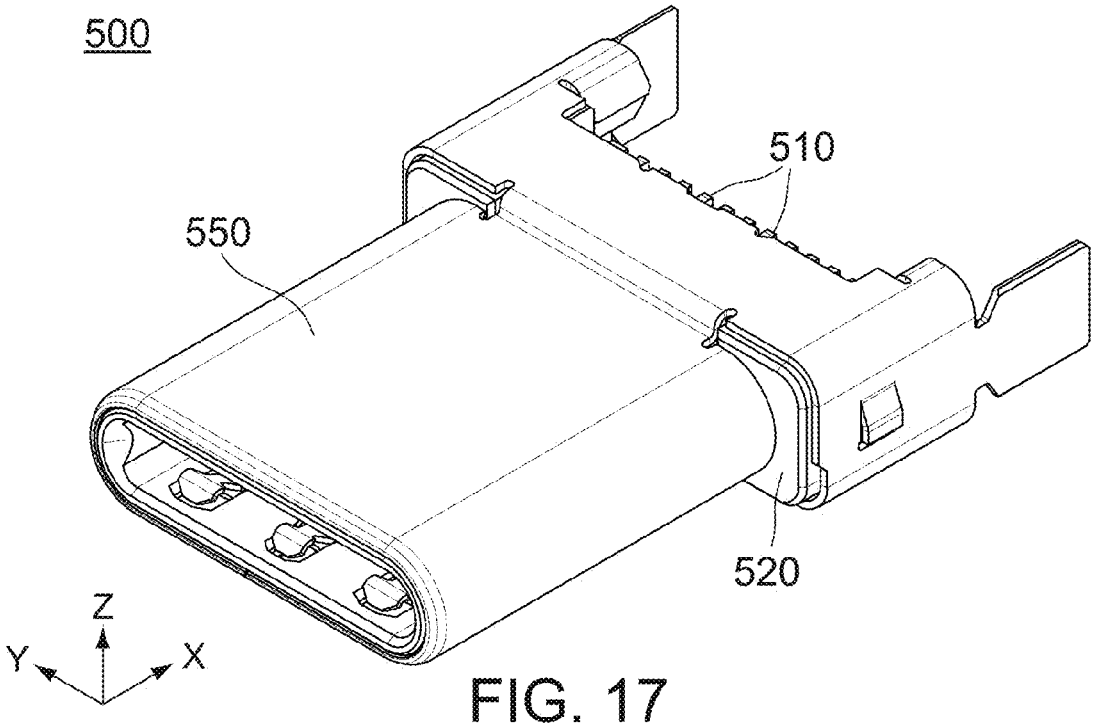
FIG. 17 is an upper perspective view showing a mating connector which is mateable with the connector of FIG. 1.

As shown in FIG. 1, a connector 100 according to an embodiment of the present invention is mounted on a circuit board 700 when used. The connector 100 is mateable with a mating connector 500 (see FIGS. 17 to 19) along a front-rear direction. In the present embodiment, the connector 100 is a receptacle connector which is in conformity with Universal Serial Bus (USB) type C standard. The mating connector 500 is a plug connector which is conformity with the aforementioned standard. The present invention, however, is not limited thereto. The present invention is applicable to various connectors which are in conformity with various standards. In the present embodiment, the front-rear direction is an X-direction. A positive X-direction is directed forward while a negative X-direction is directed rearward.

Referring to FIGS. 17 to 20, the mating connector 500 has a plurality of mating contacts 510, a mating holding member 520, a mating ground plate 530 and a mating shell 550. Each of the mating contacts 510, the mating ground plate 530 and the mating shell 550 is made of metal. The mating contact 510 is made by punching out a metal sheet and bending the punched out metal sheet. The mating ground plate 530 is made by punching out a metal sheet. The mating shell 550 is made by punching out a metal sheet and bending the punched out metal sheet. The mating holding member 520 is made of insulator and formed by molding.

Figure 18:
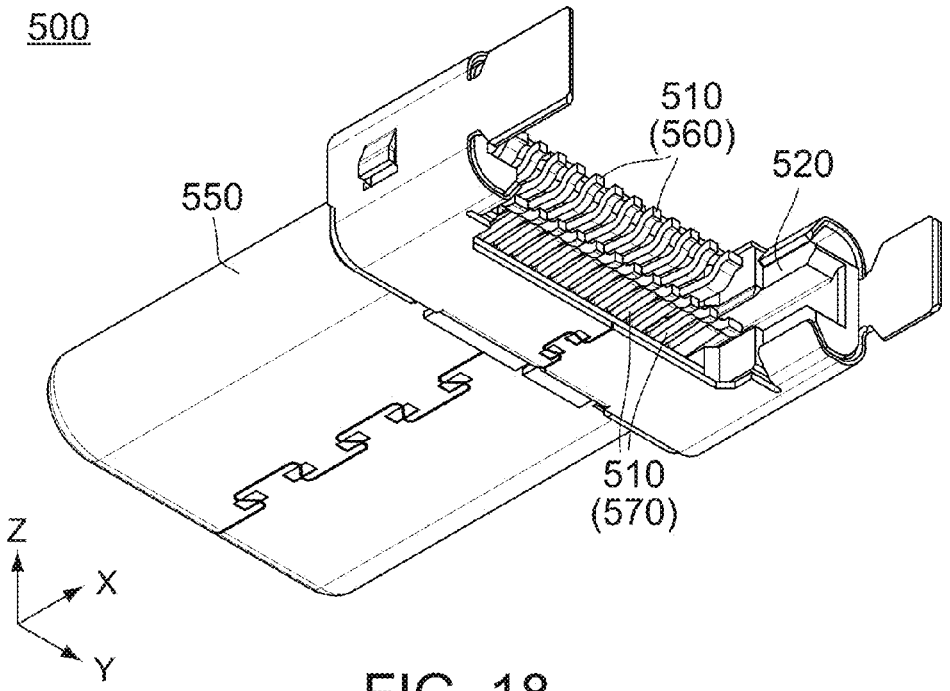
FIG. 18 is a lower perspective view showing the mating connector of FIG. 17.
Figure 19:
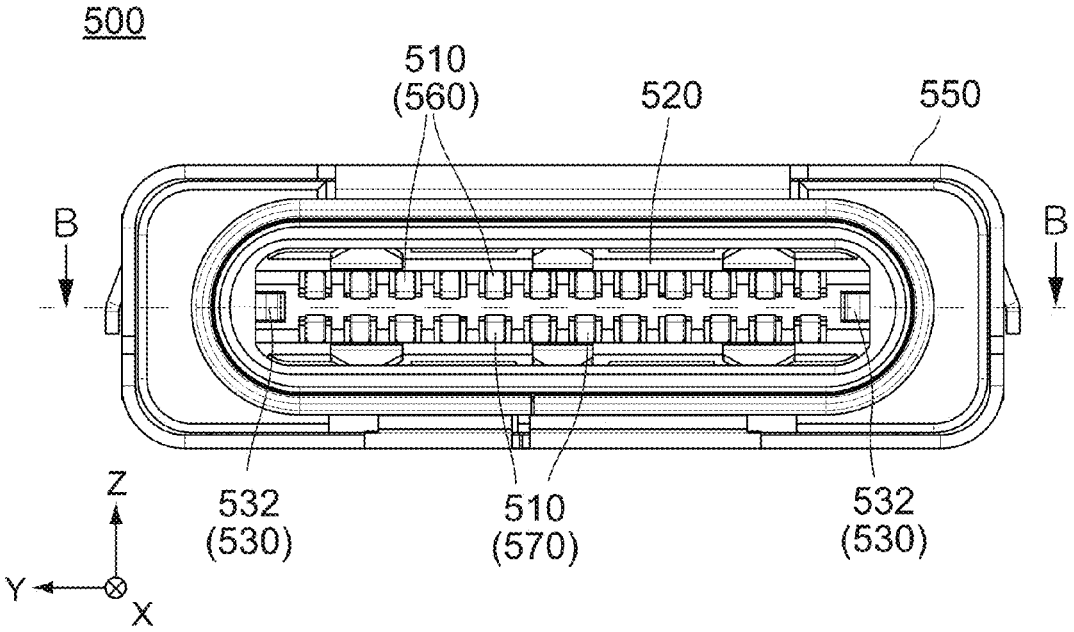
FIG. 19 is a rear view showing the mating connector of FIG. 17.
Figure 20:
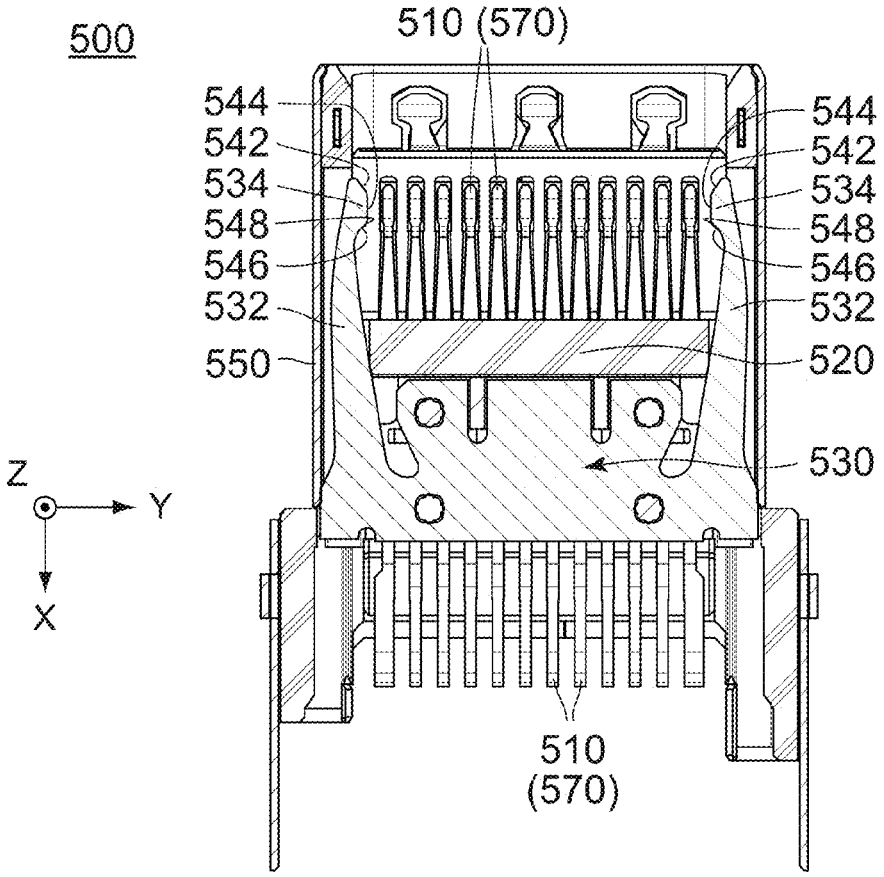
FIG. 20 is a cross-sectional view showing the mating connector of FIG. 19, taken along B-B line.

As understood from FIGS. 18 and 19, the mating contacts 510 are arranged into two rows. In other words, the mating contacts 510 form two mating contact rows 560 and 570. As shown in FIGS. 19 and 20, in each of the mating contact rows 560 and 570, the mating contacts 510 are arranged at a predetermined interval in a pitch direction perpendicular to the front-rear direction (X-direction). In the present embodiment, the pitch direction is a Y-direction. As shown in FIG. 19, the mating contact rows 560 and 570 are disposed apart from each other in an up-down direction perpendicular to both of the front-rear direction (X-direction) and the pitch direction (Y-direction). In the present embodiment, the up-down direction is a Z-direction. A positive Z-direction is directed upward while a negative Z-direction directed downward.

Figure 21:
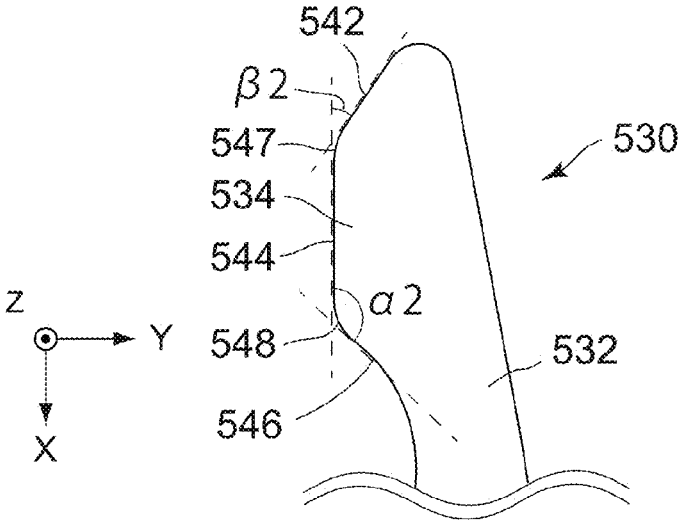
FIG. 21 is an enlarged plane view showing a tip portion of an arm portion of a mating ground plate included in the mating connector of FIG. 20.

As understood from FIGS. 19 and 20, the mating holding member 520 holds the mating contacts 510. The mating ground plate 530 is attached to the mating holding member 520. The mating ground plate 530 is situated between the mating contact rows 560 and 570 in the up-down direction (Z-direction). As shown in FIG. 20, the mating ground plate 530 has a pair of arm portions 532 which are situated outward thereof in the pitch direction (Y-direction) and extend rearward (in the negative X-direction). As shown in FIGS. 20 and 21, each of the arm portions 532 has a mating lock portion 534 which is formed at a tip portion thereof and protrudes inward in the pitch direction (Y-direction). As understood from FIGS. 17 to 20, the mating shell 550 accommodates the mating contacts 510, the mating holding member 520 and the mating ground plate 530.

Figure 3:
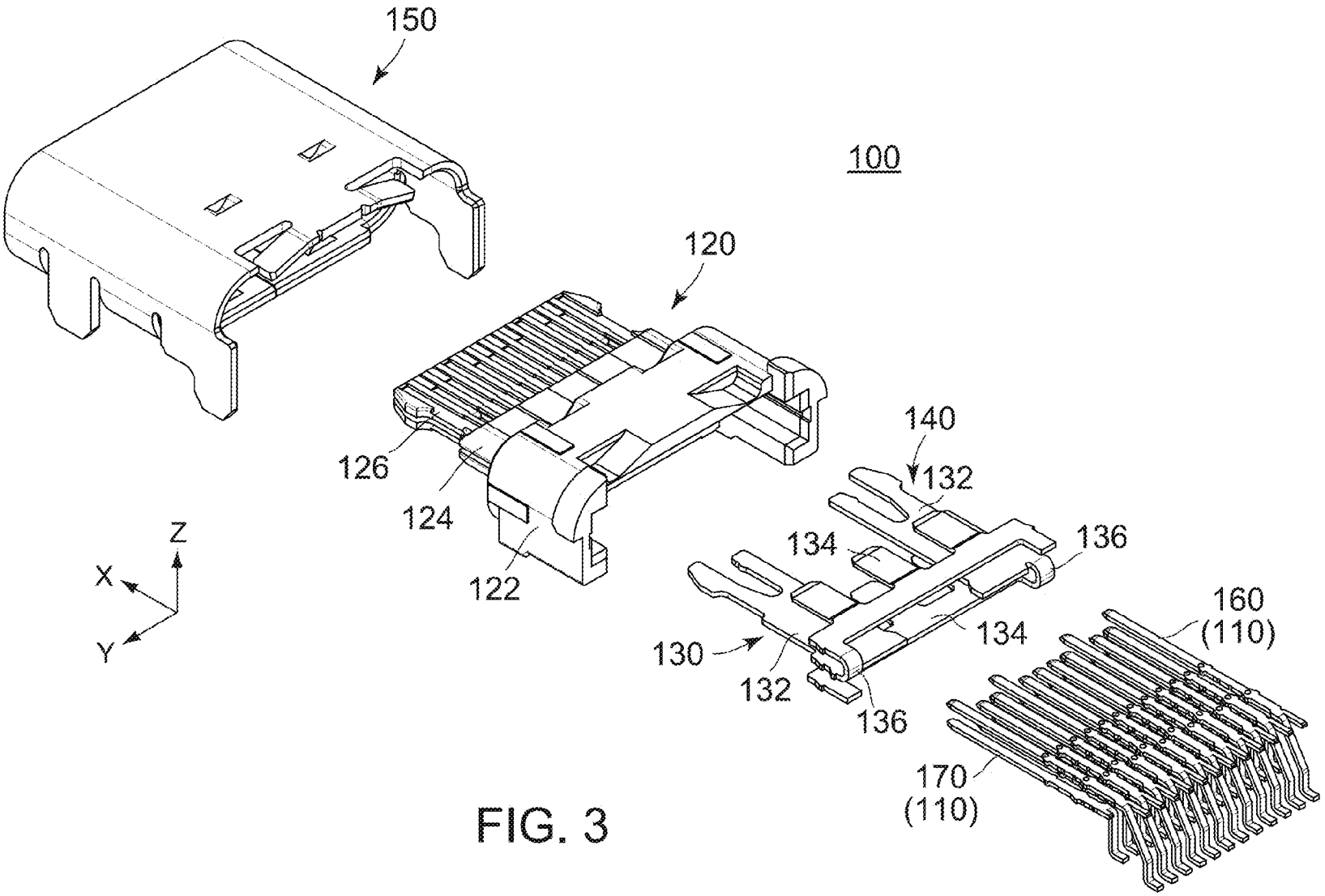
FIG. 3 is an exploded perspective view showing to the connector of FIG. 1.

Referring to FIG. 3, the connector 100 is provided with a plurality of contacts 110, a holding member 120, two complex plates 130 and 140 and a shell 150. Each of the contacts 110, the complex plates 130 and 140 and the shell 150 is made of metal. Each of the contacts 110, the complex plates 130 and 140 and the shell 150 is made by punching out a metal sheet and bending the punched out metal sheet. The holding member 120 is made of insulator and formed by molding.

As understood from FIGS. 1 to 5, the contacts 110 are arranged into two rows. In other words, the contacts 110 form two contact rows, i.e. an upper contact row 160 and a lower contact row 170. In each of the upper and the lower contact rows 160 and 170, the contacts 110 are arranged at the predetermined interval in the pitch direction (Y-direction). The upper and the lower contact rows 160 and 170 are disposed apart from each other in the up-down direction (Z-direction). The contacts 110 are arranged to correspond to the mating contacts 510, respectively.

Figure 7:
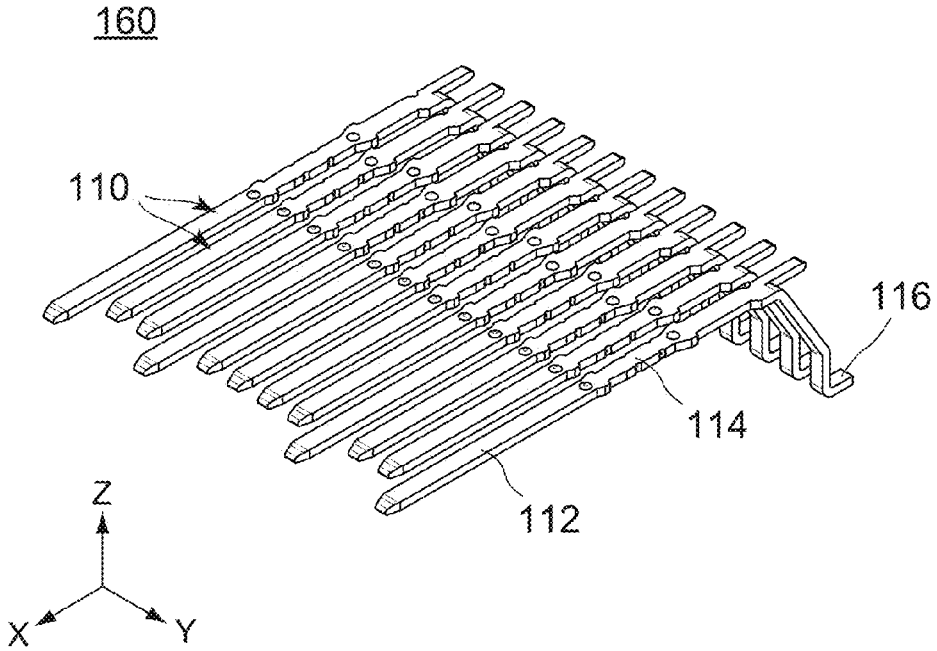
FIG. 7 is a perspective view showing a first contact row included in the connector of FIG. 1.
Figure 8:
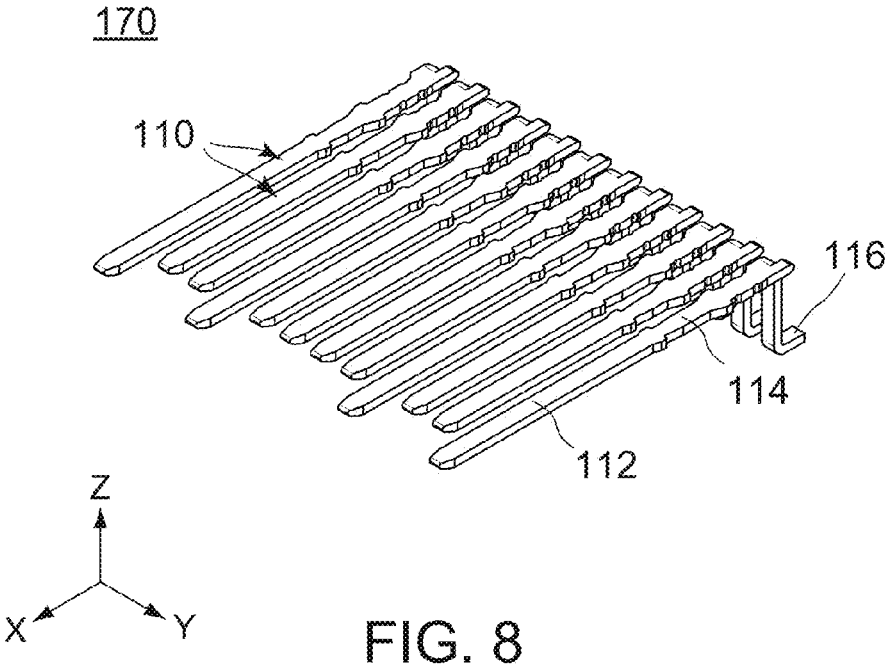
FIG. 8 is a perspective view showing a second contact row included in the connector of FIG. 1.

As understood from FIGS. 7 and 8, the contacts 110 have slightly different shapes according to their positions and their intended use. However, the contacts 110 are common with one another in basic structure. Specifically, each of the contacts 110 has a contact portion 112, a held portion 114 and fixed portion 116. The contact portion 112 is situated forward (at a positive X-direction side) of the held portion 114 in the front-rear direction (X-direction). The contact portion 112 is brought into contact with the mating contact 510 (see FIGS. 17 to 20) corresponding thereto when the connector 100 and the mating connector 500 are mated with each other. The held portion 114 is situated between the contact portion 112 and the fixed portion 116. The held portion 114 has press-fit portions protruding outward thereof in the pitch direction (Y-direction) to be held by the holding member 120. The fixed portion 116 is situated rearward (at a negative X-direction side) of the held portion 114 in the front-rear direction (X-direction). The fixed portion 116 is situated downward (at a negative Z-direction side) of the contact portion 112 and the held portion 114 in the up-down direction (Z-direction). The fixed portion 116 is connected and fixed to an electrode pad (not shown) formed on the circuit board 700 (see FIG. 1).

Referring to FIGS. 9 to 13, the holding member 120 has a base portion 122, a holding portion 124 and a mating portion 126. The base portion 122 is situated rearward (at the negative X-direction side) of the holding portion 124 and has a front portion 212, an upper portion 214 and two side portions 216. The front portion 212 is a thick plate-like portion extending in the Y-direction and the Z-direction. The upper portion 214 extends rearward (in the negative X-direction) from an upper edge (an edge of the positive Z-direction) of the front portion 212. The side portions 216 extend rearward (in the negative X-direction) from edges positioned outward of the front portion 212 in the pitch direction (Y-direction). The side portions 216 continue to the upper portion 214 at their upper ends (ends in the positive Z-direction). The base portion 122 opens rearward and downward (in the negative X-direction and the negative Z-direction).

Figure 9:
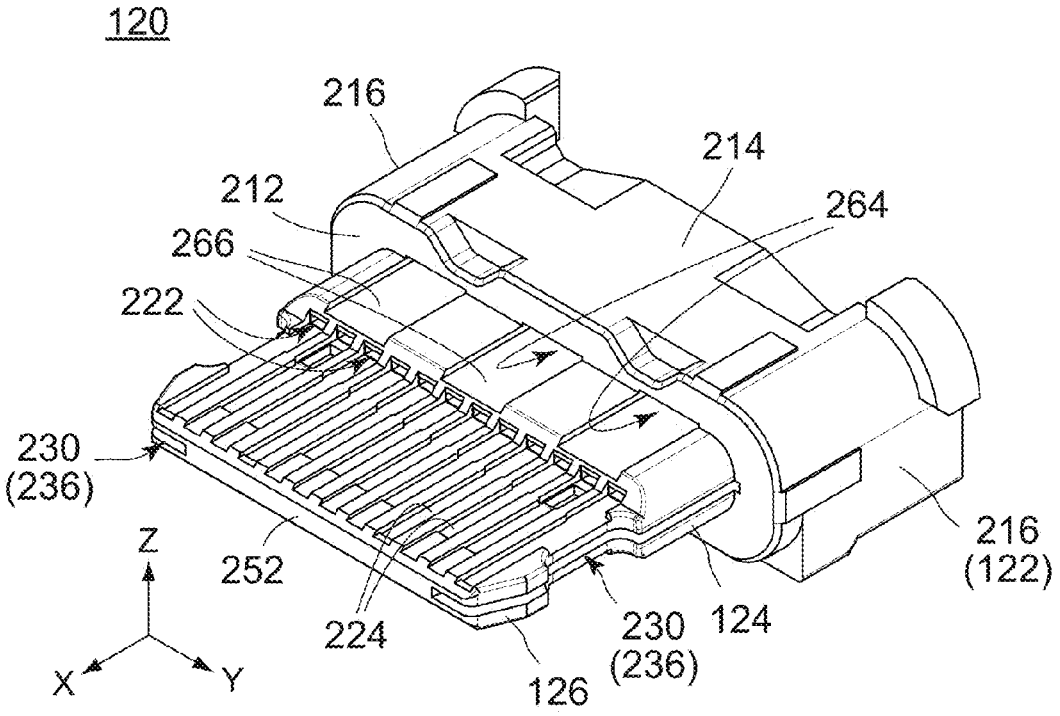
FIG. 9 is an upper perspective view showing a holding member included in the connector of FIG. 1.
Figure 10:
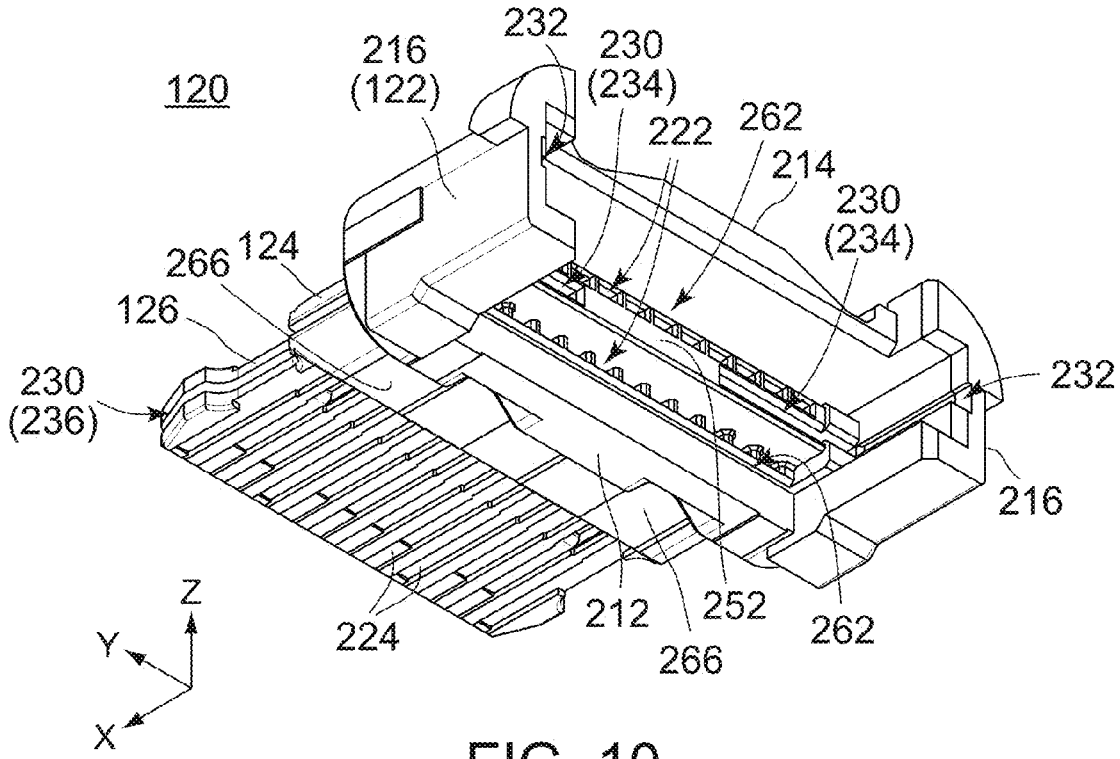
FIG. 10 is a lower perspective view showing the holding member of FIG. 9.
Figure 11:
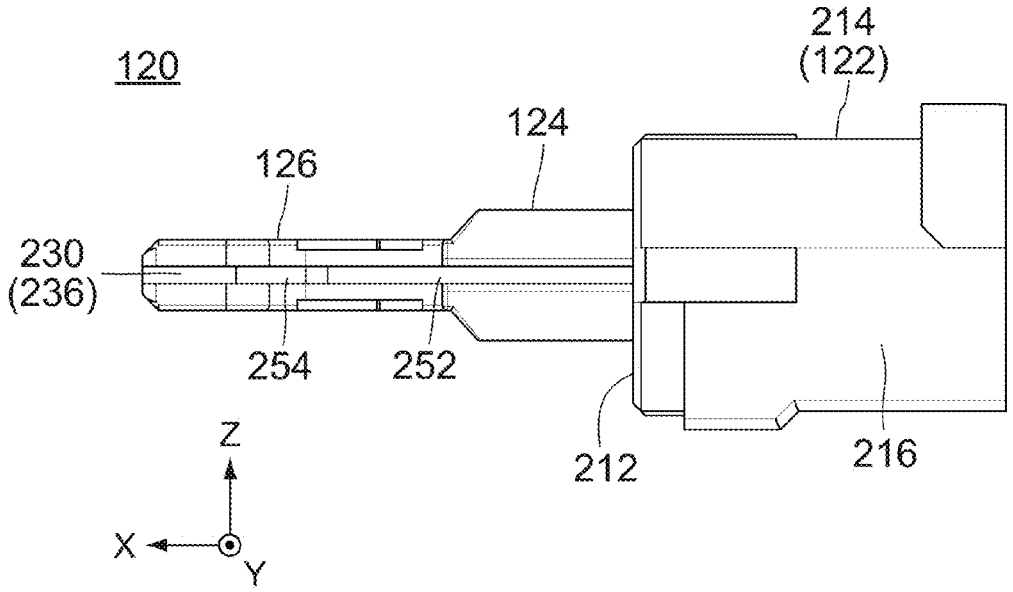
FIG. 11 is a right side view showing the holding member of FIG. 9.

As understood from FIGS. 9 to 11, the holding portion 124 is situated forward (at the positive X-direction side) of the base portion 122 and rearward (at the negative X-direction side) of the mating portion 126 to couple the base portion 122 to the mating portion 126. The holding portion 124 has an oval sectional shape on a plane (Y-Z plane) perpendicular to the front-rear direction (X-direction). The mating portion 126 has a tongue-like shape and extends forward (in the positive X-direction) from the holding portion 124.

Figure 4:
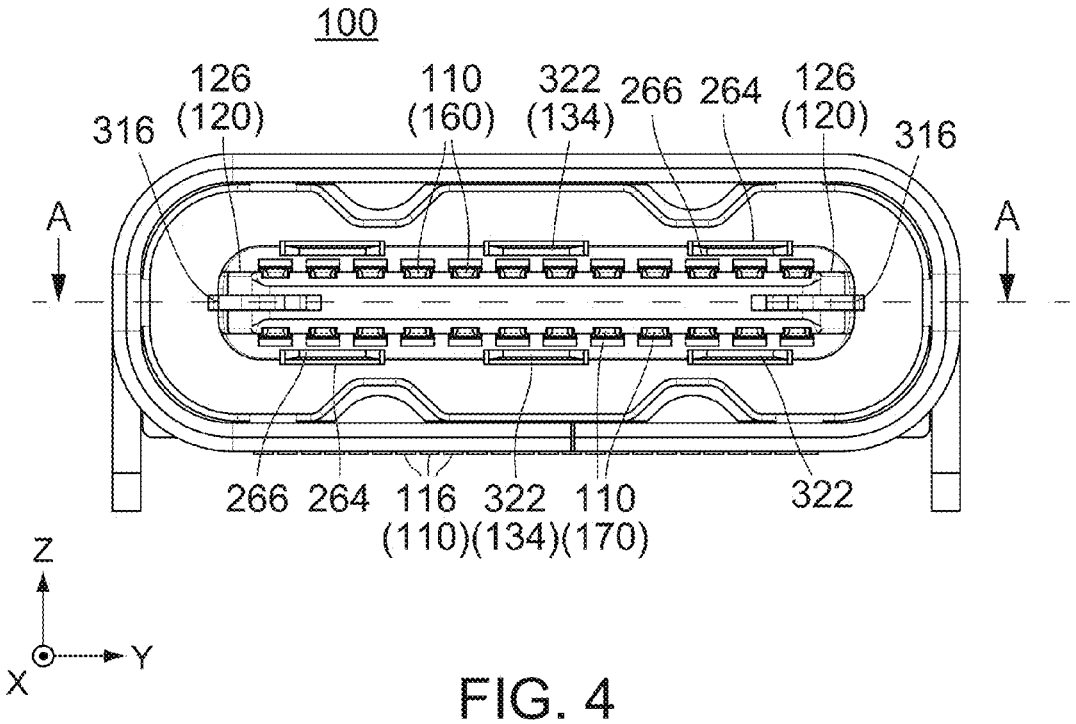
FIG. 4 is a front view showing the connector of FIG. 1.
Figure 5:
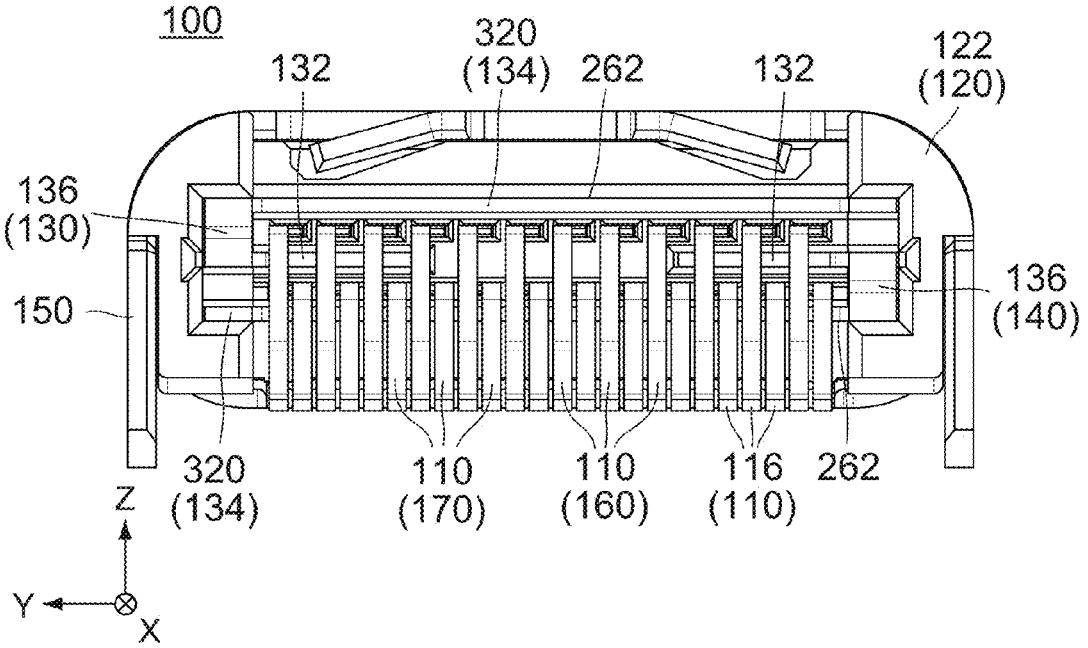
FIG. 5 is a rear view showing the connector of FIG. 1.

As understood from FIGS. 9, 10, 12 and 13, the holding member 120 has a plurality of holes 222 which penetrate therethrough in the front-rear direction (X-direction). The holes 222 continuously penetrate the front portion 212 of the base portion 122 and the holding portion 124. Rear ends (ends in the positive X-direction) of the holes 222 are situated inside the base portion 122. Front ends (ends in the negative X-direction) of the holes 222 are situated at a tip of the holding portion 124. The mating portion 126 has an upper surface (a surface in a positive Z-direction) and a lower surface (a surface in the negative Z-direction). Each of the upper and the lower surfaces are formed with a plurality of channels 224 continuing to the holes 222. Each of the holes 222 and the channel 224 continuing thereto corresponds to one of the contacts 110. Each of the contacts 110 is moved forward (in the positive X-direction) to be press-fit into the hole 222 corresponding thereto from a rear end (an end in the negative X-direction) of the holding member 120. In this event, the contact portion 112 passes through the hole 222 to be accommodated by the channel 224 in part and to be supported by the mating portion 126. The held portion 114 is situated inside the hole 222 and supported by the holding portion 124. The fixed portion 116 is situated rearward (at the positive X-direction side) of the hole 222 without being inserted in the hole 222. As shown in FIGS. 4 and 5, the fixed portion 116 of the contact 110 protrudes downward (in the negative Z-direction) from the base portion 122 of the holding member 120 in part.

As shown in FIGS. 9 to 13, the holding member 120 further has two accommodation portions 230 extending forward (in the positive X-direction) from the rear end (the end in the negative X-direction) thereof. Each of the accommodation portions 230 includes a channel portion 232, a slot portion 234 and a deep channel portion 236. The channel portion 232 is formed inward of the side portion 216 of the base portion 122 in the pitch direction (Y-direction). The slot portion 234 penetrates the front portion 212 of the base portion 122 in the front-rear direction (X-direction). The deep channel portion 236 opens outward of the holding portion 124 and the mating portion 126 in the pitch direction (Y-direction). As understood from FIG. 6, the deep channel portion 236 has a first receiving portion 242 and a second receiving portion 244 at a front end portion (an end portion in the positive X-direction) thereof. The first receiving portion 242 opens forward (in the positive X-direction) while the second receiving portion 244 does not open forward (in the positive X-direction).

Figure 12:
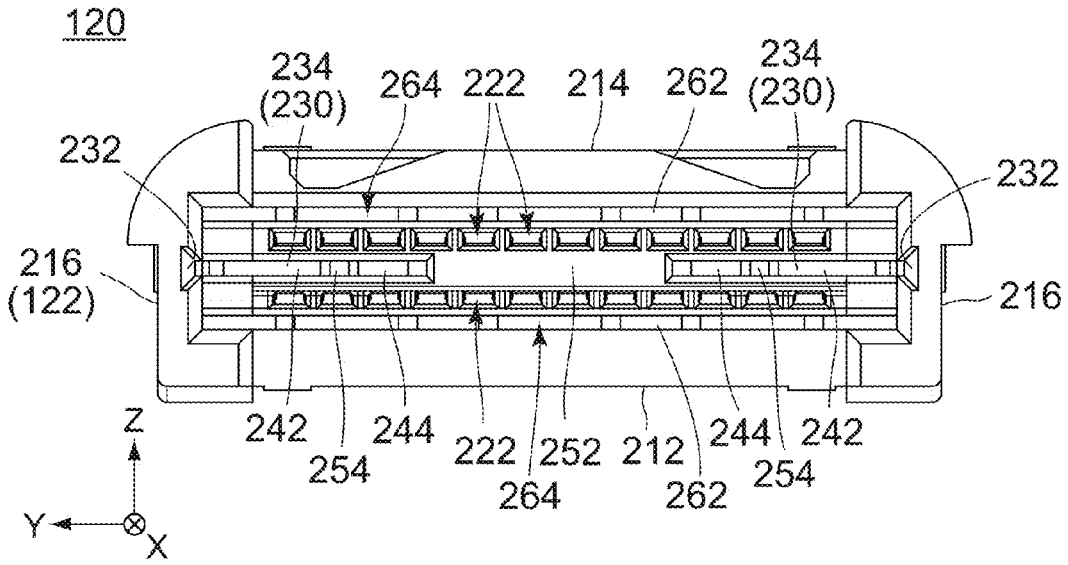
FIG. 12 is a rear view of the holding member of FIG. 9.
Figure 13:
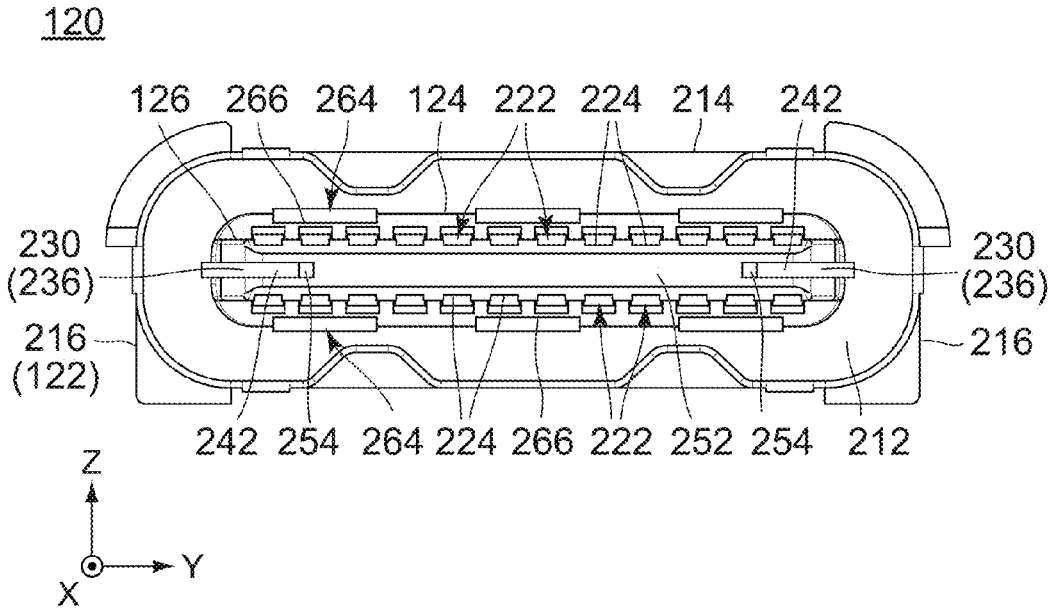
FIG. 13 is a front view of the holding member of FIG. 9.

Referring to FIGS. 9 and 12, the holding member 120 further has two slot portions 262 outward of the rows of the holes 222 in the up-down direction (Z-direction). The slot portions 262 are channels formed in a rear end portion (an end portion in the negative X-direction) of the front portion 212 and extending in the pitch direction (Y-direction). As shown in FIGS. 9, 10, 12 and 13, the holding member 120 further has six holes 264. The holes 264 penetrate the front portion 212 along the front-rear direction (X-direction) and lead to the slot portion 262. When seen along the front-rear direction, each of the holes 264 has a rectangular sectional shape which is long in the pitch direction (Y-direction) and short in the up-down direction (Z-direction). The holding member 120 still further has shallow channels 266 formed in an upper and a lower surfaces of the holding portion 124. The shallow channels 266 correspond to the holes 264, respectively. The shallow channels 266 are formed to continue to the holes 264 corresponding thereto in the front-rear direction.

As shown in FIGS. 6 and 9 to 13, the holding member 120 has a middle portion 252 situated between the accommodation portions 230 in the pitch direction (Y-direction). The middle portion 252 extends from the rear end (the end in the negative X direction) of the front portion 212 to a front end (an end in the positive X-direction) of the mating portion 126. The middle portion 252 ensures strength necessary for the holding member 120. In other words, the middle portion 252 restricts strength reduction, which is caused by forming the two accommodation portions 230, of the holding member 120. The holding member 120 further has regulating portions 254. Each of the regulating portions 254 is situated between the first receiving portion 242 and the second receiving portion 244 in the pitch direction (Y-direction). The regulating portion 254 is formed in the mating portion 126 and extends in about front-rear direction (X-direction). The regulating portion 254 is coupled to the middle portion 252 at a front end portion (an end portion in the positive X-direction) of the mating portion 126.

Figure 14:
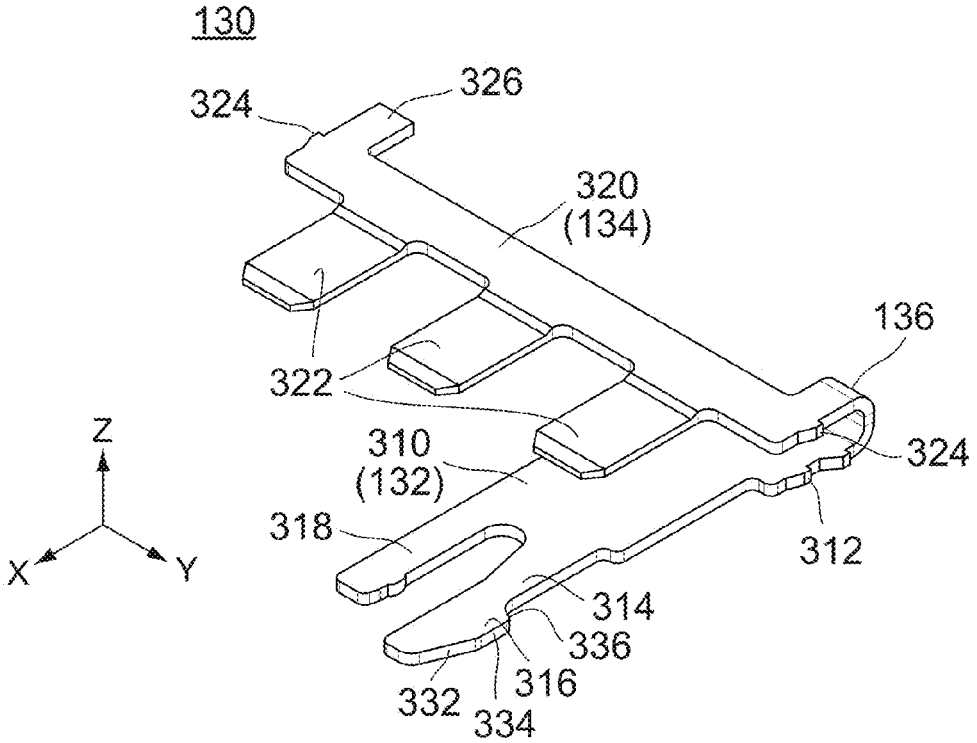
FIG. 14 is an upper perspective view showing a complex plate included in the connector of FIG. 1.
Figure 15:
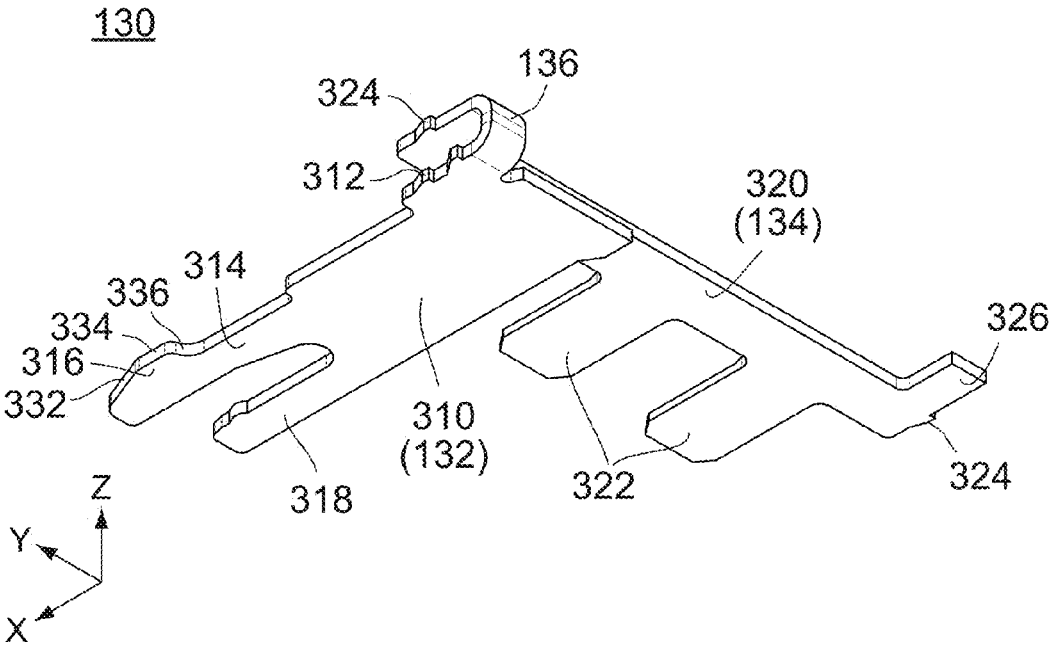
FIG. 15 is a lower perspective view showing the complex plate of FIG. 14.

As understood from FIG. 3, the complex plates 130 and 140 have a shape same as each other. In other words, the complex plate 140 is identical to the complex plate 130 that is reversed upside down. The description will be made about the complex plate 130 hereinafter. However, the description is applicable to the complex plate 140. Referring to FIGS. 14 and 15, the complex plate 130 has a flat plate portion 132, a ground plate portion (a ground plate) 134 and a coupling portion 136.

As understood from FIGS. 14 and 15, roughly speaking, the flat plate portion 132 has a shape which is long in the front-rear direction (X-direction) and short in the pitch direction (Y-direction). The ground plate portion 134 has a shape which is short in the front-rear direction (X-direction) and long in the pitch direction (Y-direction). The coupling portion 136 couples the flat plate portion 132 to the ground plate portion 134, with the flat plate portion 132 and the ground plate portion 134 being apart from each other in the up-down direction (Z-direction). The coupling portion 136 has a U-shape when seen along the pitch direction (Y-direction). The coupling portion 136 couples a rear end (an end in the negative X direction) of the flat plate portion 132 to a rear end (an end in the negative X-direction) of the ground plate portion 134 at one of end portions in the pitch direction (Y-direction), i.e. an end portion in a positive Y-direction. In the present embodiment, the flat plate portion 132, the ground plate portion 134 and the coupling portion 136 are formed in a body. In detail, the flat plate portion 132, the ground plate portion 134 and the coupling portion 136 are formed by cutting a single metal sheet and bending the cut metal sheet. However, the present invention is not limited thereto. The coupling portion 136 may be eliminated so that the flat plate portion 132 and the ground plate portion 134 are formed in different parts separated from each other. Nevertheless, it is desirable that the flat plate portion 132 and the ground plate portion 134 are formed in a single part (the complex plate 130) in which they are coupled by the coupling portion 136. This is because the number of parts and the number of assembly processes can be reduced.

As shown in FIGS. 14 and 15, the flat plate portion 132 has a base portion 310, a press-fit portion 312, a spring portion 314, a lock portion 316 and a regulated portion 318. The base portion 310 has a roughly rectangular shape which is long in the front-rear direction (X-direction) in a plane view. In other words, the base portion 310 extends in the front-rear direction (X-direction) and in the pitch direction (Y-direction). The press-fit portion 312 is a protrusion which protrudes from the base portion 310 in one direction (positive Y-direction) along the pitch direction (Y-direction). The press-fit portion 312 is formed at one of ends (an end in the positive Y-direction) of the base portion 310 in the pitch direction (Y-direction) and situated near a rear end (an end in the negative X-direction) of the base portion 310. The spring portion 314 extends forward (in the positive X-direction) from the base portion 310. The spring portion 314 is situated near the one of the ends (the end in the positive Y-direction) of the base portion 310 in the pitch direction (Y-direction). The spring portion 314 is formed to have resilience in the pitch direction (Y-direction). The lock portion 316 is formed near a tip (an end in the positive X-direction) of the spring portion 314 and protrudes in one direction (positive Y-direction) along the pitch direction (Y-direction). In other words, the lock portion 316 is supported by the spring portion 314. The lock portion 316 is movable in the pitch direction (Y-direction) due to elastically deforming of the spring portion 314. Like the spring portion 314, the regulated portion 318 extends forward (in the positive X-direction) from the base portion 310. The regulated portion 318 and the spring portion 314 are apart from each other in the pitch direction (Y-direction). The regulated portion 318 is situated near the other end (the end in a negative Y-direction) of the base portion 310 in the pitch direction (Y-direction).

As shown in FIGS. 14 and 15, the ground plate portion 134 has a base portion 320, three protrusion portions 322, press-fit portions 324 and auxiliary portion 326. The base portion 320 has a roughly rectangular shape which is long in the pitch direction (Y-direction). The base portion 320 couples rear ends (ends in the negative X-direction) of the protrusion portions 322 to one another. The protrusion portions 322 extend forward (in the positive X-direction) from a front end (an end in the positive X-direction) of the base portion 320. The press-fit portions 324 are provided at both sides of the base portion 320 in the pitch direction (Y-direction) and protrude outward of the base portion 320 in the pitch direction (Y-direction). The auxiliary portion 326 extends rearward (in the negative X-direction) from a rear end (an end in the negative X-direction) of the base portion 320. The auxiliary portion 326 is provided near the other end (the end in the negative Y-direction) of the base portion 320 in the pitch direction (Y-direction).

Figure 6:
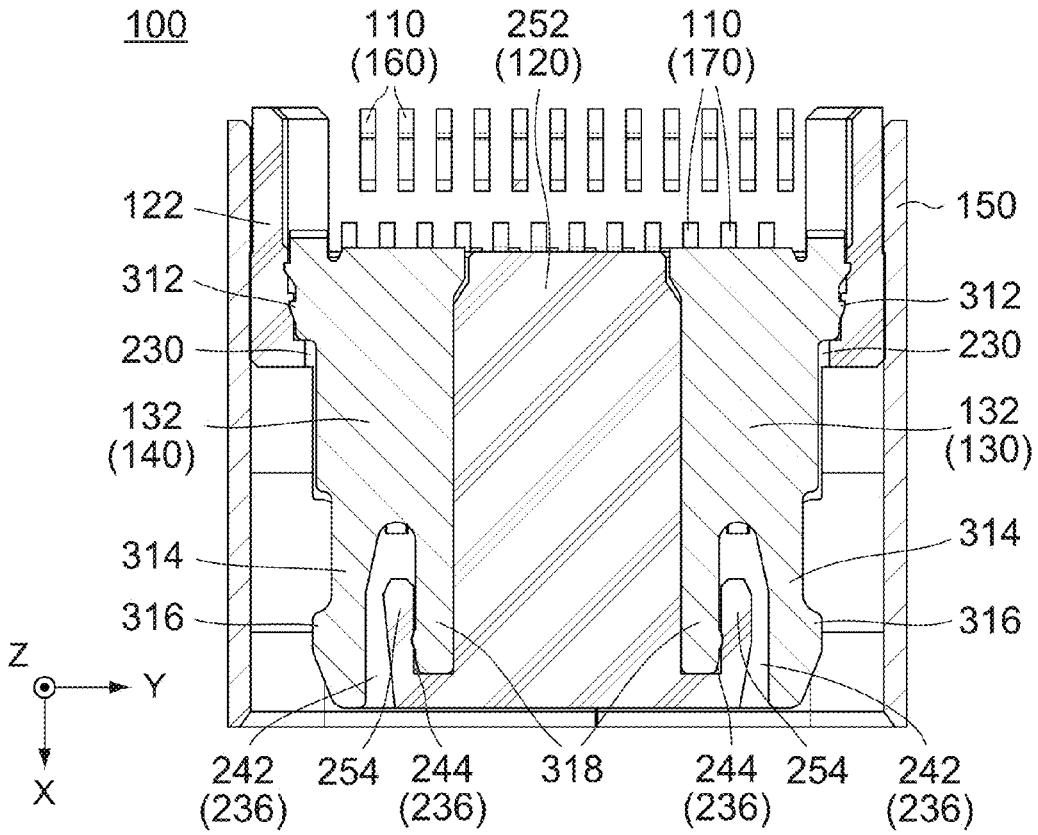
FIG. 6 is a cross-sectional view showing the connector of FIG. 4, taken along A-A line.

As understood from FIG. 3, the complex plates 130 and 140 are pressed forward (in positive X-direction) and press-fit into the holding member 120 through the rear end (the end in the negative X-direction) of the holding member 120. As a result, the two flat plate portions 132 are accommodated in the accommodation portions 230 of the holding member 120, respectively, as shown in FIG. 6. At this time, the base portions 320 of the ground plate portions 134 are accommodated in the slot portions 262 as understood from FIGS. 4 and 5. The protrusion portions 322 of the ground plate portions 134 are inserted into the holes 264 corresponding thereto, and tip portions (end portions in the positive X-direction) of them are received by the shallow channels 266. Each of the protrusion portions 322 of the ground plate portions 134 is partly situated inside the holes 264.

As shown in FIG. 6, the two flat plate portions 132 have shapes which are mirror symmetrical to each other in a state where they are accommodated in the accommodation portions 230. The middle portion 252 is situated between the two flat plate portions 132. In other words, the middle portion 252 is interposed between the two flat plate portions 132 in the pitch direction (Y-direction). The two flat plate portions 132 form a mid-plate. In other words, the connector 100 is provided with a mid-plate, and the mid plate has the two flat plate portions 132. The mid-plate serves as a ground conductor which is situated between the upper contact row 160 and the lower contact row 170. Accordingly, the contacts 110 that are overlapped with any one of the flat plate portions 132 when seen along the up-down direction (Z-direction) are suitable for transmission of high speed signal. In other words, such contacts 110 are suitable for use in a differential pair. On the other hand, the contacts 110 that are not overlapped with the flat plate portions 132 when seen along the up-down direction (Z-direction) are suitable for transmission of low speed signal.

As understood from FIG. 6, the press-fit portions 312 are pressed against or bites the base portion 122 of the holding member 120 to fix the complex plates 130 and 140 to the holding member 120. The holding member 120 needs a certain level of strength at parts corresponding to the press-fit portions 312. Accordingly, the press-fit portion 312 is situated near the rear end of the flat plate portion 132 (or the base portion 310) to correspond to the base portion 122 which is easy to form in thick.

As shown in FIG. 6, the spring portion 314 and the regulated portion 318 are received by the first and the second receiving portions 242 and 244, respectively. In detail, the spring portion 314 is apart from the regulating portion 254 and received by the first receiving portion 242 in a state where it is resiliently deformable at least inward in the pitch direction (Y-direction). The regulated portion 318 is received by the second receiving portion 244 to be preferably unmovable in the pitch direction (Y-direction). In other words, it is desirable that the regulated portion 318 is situated inward of the regulating portion 254 in the pitch direction (Y-direction) and abuts on the regulating portion 254. The regulated portion 318 prevents the flat plate portion 132 from being turned by strong frictional force, which is caused between the lock portion 316 and the mating lock portion 534, when the connector 100 and the mating connector 500 are mated with each other.

As shown in FIGS. 1 and 4, the lock portion 316, at least in part, protrudes outward of the mating portion 126 (or the holding member 120) in the pitch direction (Y-direction). As understood from FIG. 6, a position of the regulated portion 318, a position of the regulating portion 254 and a position of the lock portion 316 are overlapped in the front-rear direction (X-direction) in the present embodiment. In other words, the regulated portion 318, the regulating portion 254 and the lock portion 316 are overlapped when seen along the pitch direction (Y-direction).

Figure 16:
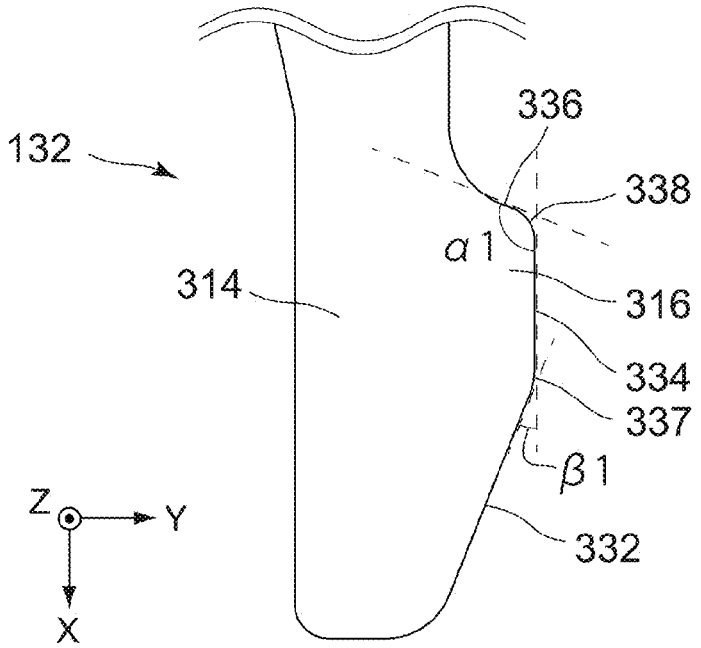
FIG. 16 is an enlarged plane view showing a tip portion of a spring portion of the complex plate of FIG. 14.

Referring to FIG. 16 in addition to FIGS. 14 and 15, the lock portion 316 has a first slide surface 332, a second slide surface (a slide surface) 334, a lock surface 336 and curved surface portions 337 and 338. The first slide surface 332 extends outward-diagonally backward (in the negative X-direction and outward in the pitch direction (Y-direction)) from the tip (the end portion of the positive X-direction) of the spring portion 314. The second slide surface 334 continues to the first slide surface 332 via the curved surface portion 337 and extends rearward (in the negative X-direction). The lock surface 336 continues to the second slide surface 334 via the curved surface portion 338 and extends inward-diagonally rearward (in the negative X-direction and inward in the pitch direction (Y-direction)). The second slide surface 334 and the lock surface 336 form an angle $\alpha 1$ in the lock portion 316. The angle $\alpha 1$ is larger than 90 degrees (right angle). That is, the lock surface 336 and the second slide surface 334 form an obtuse angle. In other words, the lock surface 336 is inclined forward (in the positive X-direction) and outward in the pitch direction (Y-direction). The angle $\alpha 1$ formed by the lock surface 336 and the second slide surface 334 is larger than an angle $\beta 1$ (smaller one of two angles) formed by the first slide surface 332 and the front-rear direction (X-direction). In the present embodiment, the second slide surface 334 is parallel to the front-rear direction (X-direction). However, the second slide surface 334 may be inclined with respect to the front-rear direction (X-direction).

Referring to FIGS. 20 and 21, the mating lock portion 534 has a first mating slide surface 542, a second mating slide surface (a mating slide surface) 544, a mating lock surface 546 and mating curved surface portions 547 and 548. The first mating slide surface 542 extends inward-diagonally forward (in the positive X-direction and inward in the pitch direction (Y-direction)) from the tip (the end portion of the positive X-direction) of the arm portion 532. The second mating slide surface 544 continues to the first mating slide surface 542 via the mating curved surface portion 547 and extends forward (in the positive X-direction). The mating lock surface 546 continues to the second mating slide surface 544 via the mating curved surface portion 548 and extends outward-diagonally forward (in the positive X-direction and outward in the pitch direction (Y-direction)). In other words, the mating lock surface 546 is inclined rearward (in the negative X-direction) and inward in the pitch direction (Y-direction). The second mating slide surface 544 and the mating lock surface 546 form an angle α2 in the mating lock portion 534. The angle α2 is larger than 90 degrees (right angle). That is, the mating lock surface 546 and the second mating slide surface 544 form an obtuse angle. The angle α2 formed by the mating lock surface 546 and the second mating slide surface 544 is larger than an angle 132 (smaller one of two angles) formed by the first mating slide surface 542 and the front-rear direction (X-direction).

Figure 22:
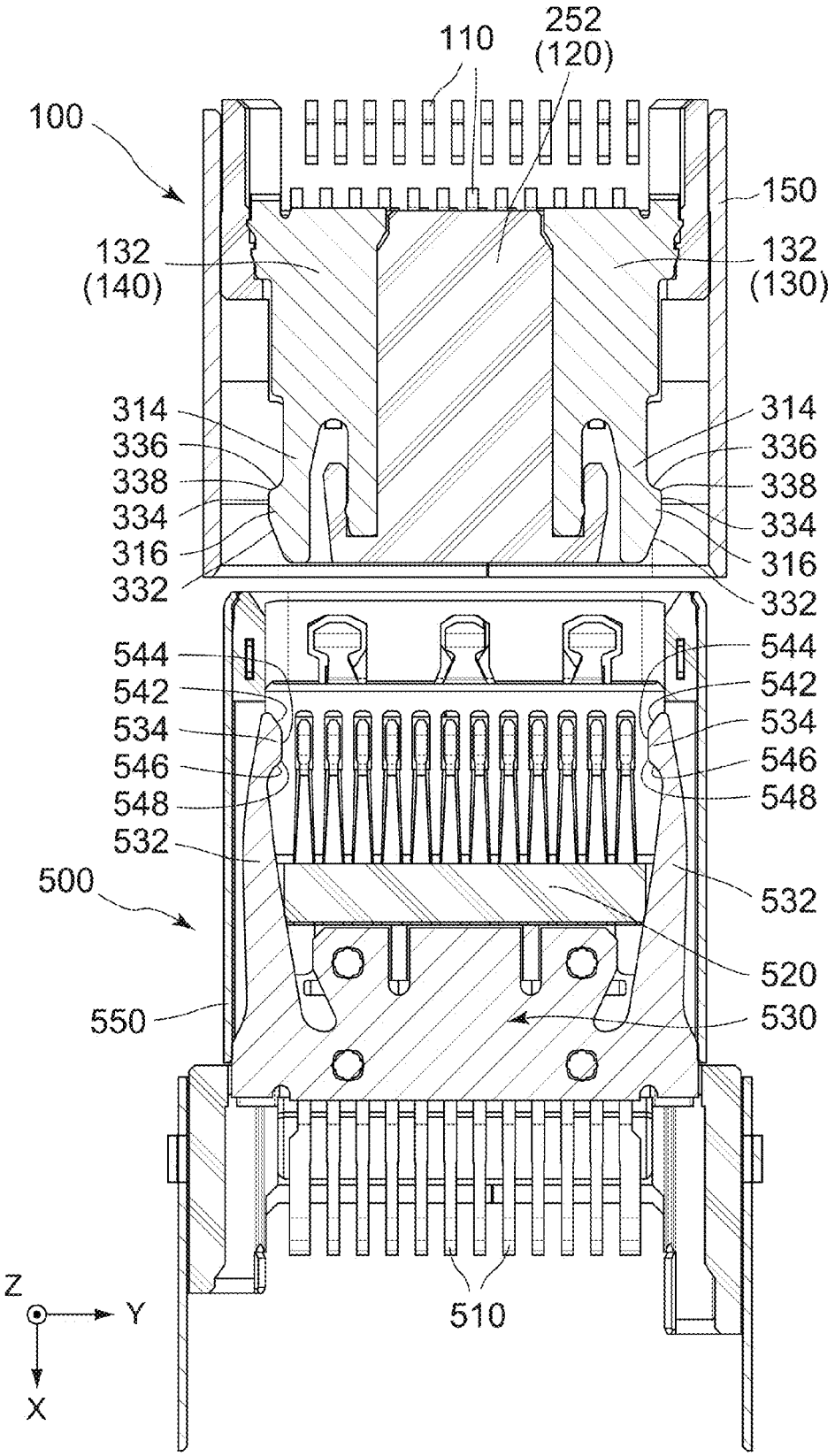
FIG. 22 is a cross-sectional view showing the connector of FIG. 1 and the mating connector of FIG. 17. The connector and the mating connector are in a separated state.
Figure 23:
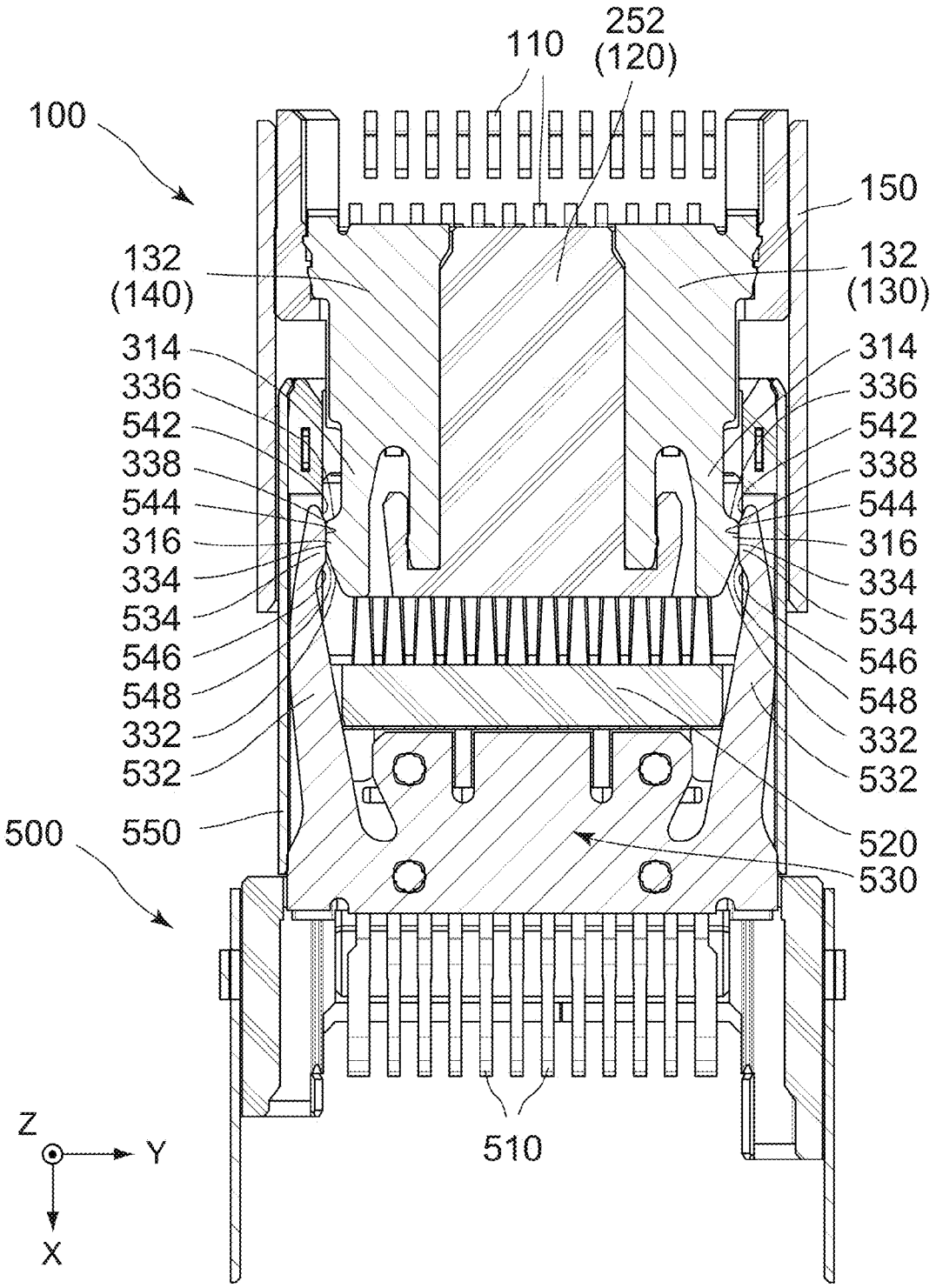
FIG. 23 is another cross-sectional view showing the connector of FIG. 1 and the mating connector of FIG. 17. The connector and the mating connector are in an incomplete mated state.

As understood from FIGS. 22 and 23, the first slide surface 332 and the first mating slide surface 542 are brought into contact with each other and slide on each other while a state of the connector 100 and the mating connector 500 is changed from a separated state (see FIG. 22) to an incomplete mated state (see FIG. 23). In this event, the spring portion 314 and the arm portion 532 are resiliently deformed according to force received by the lock portion 316 and the mating lock portion 534, respectively. In detail, the spring portion 314 is resiliently deformed inward in the pitch direction (Y-direction). On the other hand, the arm portion 532 is resiliently deformed outward in the pitch direction (Y-direction). In this manner, frictional force caused between the first slide surface 332 and the first mating slide surface 542 is reduced in comparison with a case where the lock portion 316 is formed to be unmovable. After that, as shown in FIG. 23, the second slide surface 334 and the second mating slide surface 544 are brought into contact with each other and slide on each other. In this state, frictional force caused between the second slide surface 334 and the second mating slide surface 544 is reduced in comparison with a case where the lock portion 316 is formed to be unmovable. Thus, the present embodiment suppresses abrasion of the lock portion 316.

Figure 24:
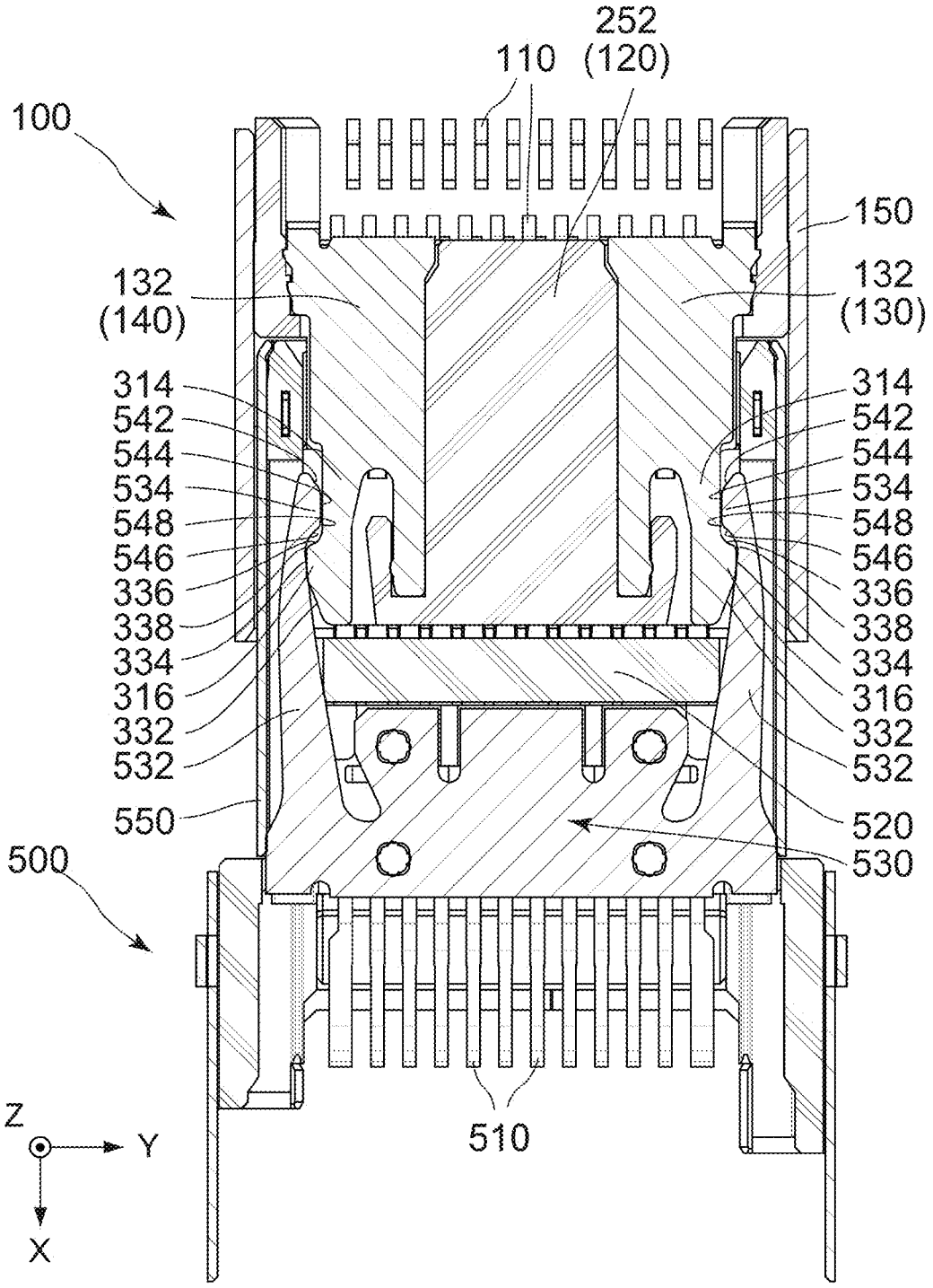
FIG. 24 is still another cross sectional view showing the connector of FIG. 1 and the mating connector of FIG. 17. The connector and the mating connector are in a mated state.
Figure 25:
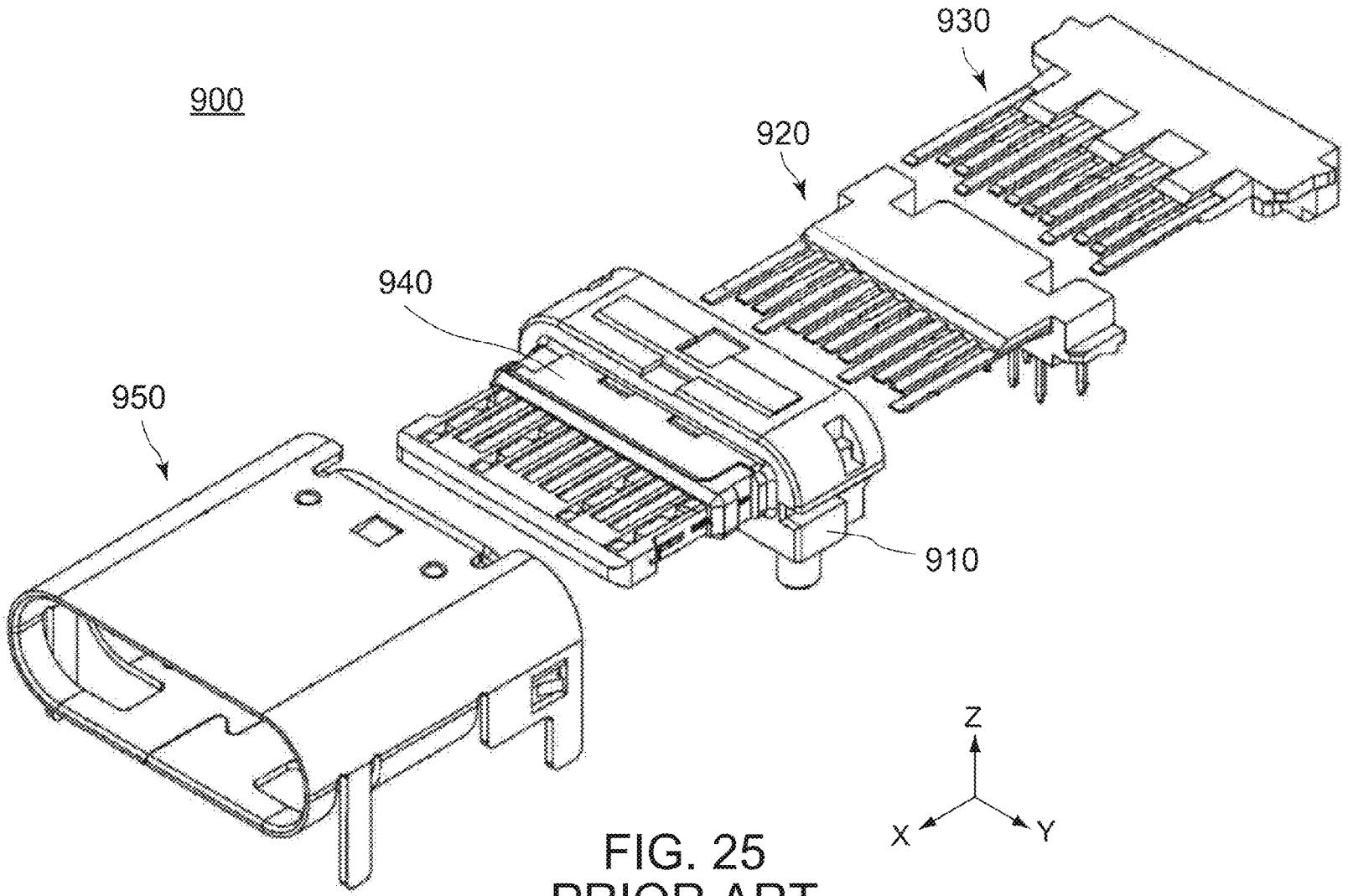
FIG. 25 PRIOR ART
FIG. 25 is an exploded perspective view showing a connector disclosed in Patent Document 1.
Figure 26:
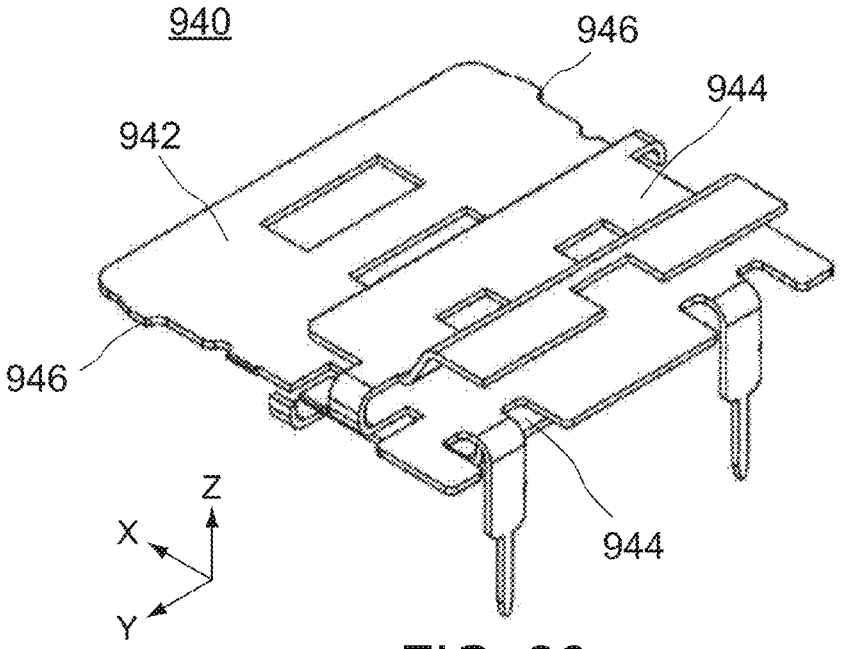
FIG. 26 PRIOR ART
FIG. 26 is a perspective view showing a grounding conductor included in the connector of FIG. 25.
Figure 27:
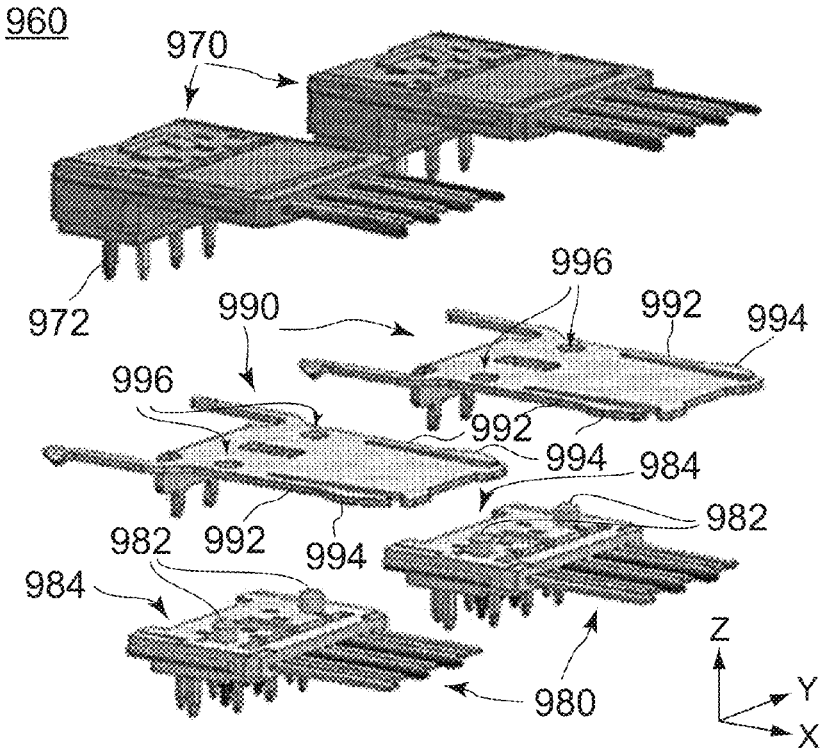
FIG. 27 PRIOR ART
FIG. 27 is an exploded perspective view showing an assembly included in a connector disclosed in Patent Document 2.

As understood from FIGS. 23 and 24, when the state of the connector 100 and the mating connector 500 changes from the incomplete mated state (see FIG. 23) to a mated state (see FIG. 24), the lock portion 316 rides over the mating lock portion 534 and is situated forward (beyond the positive X-direction side) of the mating lock portion 534. On the other hand, the mating lock portion 534 rides over the lock portion 316 and is situated rearward (beyond the negative X-direction side) of the lock portion 316. As a result, the mated state of the connector 100 and the mating connector 500 is locked. In detail, the lock surface 336 and the mating lock surface 546 face each other in the mated state. In the present embodiment, the lock surface 336 and the mating lock surface 546 form a gap therebetween. However, the lock surface 336 and the mating lock surface 546 may be in contact with each other. When the connector 100 and the mating connector 500 receive separation force having directions to separate them, the lock surface 336 and the mating lock surface 546 are brought into contact with each other to generate frictional force therebetween. Provided that the frictional force exceeds the separation force, the connector 100 and the mating connector 500 are prevented from separating from each other. Thus, the lock surface 336 and the mating lock surface 546 lock the mated state of the connector 100 and the mating connector 500. In the mated state, the contacts 110 are in contact with and electrically connected to the mating contacts 510, respectively.

As stated before, the angle α1 formed by the lock surface 336 and the second slide surface 334 is larger than the angle β1 formed by the first slide surface 332 and the front-rear direction (X-direction). Moreover, the angle α2 formed by the mating lock surface 546 and the second mating slide surface 544 is larger than the angle β2 formed by the first mating slide surface 542 and the front-rear direction (X-direction). Accordingly, the separation force for separating the connector 100 from the mating connector 500 is larger than mating force for mating them with each other. Thus, the lock portion 316 and the mating lock portion 534 can securely lock the mated state of the connector 100 and the mating connector 500. On the other hand, both of the angle α1 formed by the lock surface 336 and the second slide surface 334 and the angle α2 formed by the mating lock surface 546 and the second mating slide surface 544 are the obtuse angles. Accordingly, the connector 100 and the mating connector 500 can be smoothly separated from each other by force exceeding a certain level.

While the present invention has been described with specific embodiments, the present invention is not limited to the aforementioned embodiments but can be variously modified and applied.

In the present embodiment, the lock portion 316 has two slide surfaces, i.e. the first and the second slide surfaces 332 and 334. However, these slide surfaces may be replaced with a single slide surface which is formed by a single flat or curved surface.

In the present embodiment, the regulating portion 254 is coupled to the middle portion 252 at the front end portion (the end portion in the positive X-direction) of the mating portion 126 of the holding member 120. However, the regulating portion 254 may not be coupled to the middle portion 252. In other words, the second receiving portion 244 of the holding member 120 may open forward (in the positive X-direction) like the first receiving portion 242.

In the present embodiment, the press-fit portion 312 of the flat plate portion 132 is formed at one of ends of the base portion 310 in the pitch direction (Y-direction), i.e. an end of the complex plate 130 in the positive Y-direction or in the negative Y-direction. However, the press-fit portion 312 may be formed at the other end of the flat plate portion 132, i.e. the other end of the complex plate 130 in the negative Y-direction or in the positive Y-direction. Alternatively, the press-fit portions 312 may be formed at both ends of the base portion 310 in the pitch direction (Y-direction).

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mateable with a mating connector along a front-rear direction, wherein:

the mating connector comprises a mating lock portion;

the connector comprises a plurality of contacts, a holding member and a mid-plate;

the contacts form two contact rows;

the contacts forming each of the contact rows are aligned in a pitch direction perpendicular to the front-rear direction;

the contact rows are arranged apart from each other in an up-down direction perpendicular to both of the front-rear direction and the pitch direction;

the holding member comprises a holding portion and a mating portion;

the holding portion holds the contacts;

the mating portion has a tongue-like shape and extends forward from the holding portion;

the holding member is formed with two accommodation portions, a middle portion and regulating portions;

the accommodation portions extend forward from a rear end of the holding member and open outward in the pitch direction at the mating portion;

the middle portion is situated between the accommodation portions in the pitch direction;

the regulating portions are formed in the mating portion;

the mid-plate comprises two flat plate portions;

the flat plate portions are accommodated by the accommodation portions, respectively, and the middle portion is sandwiched between the flat plate portions in the pitch direction;

each of the flat plate portions comprises a base portion, a press-fit portion, a spring portion, a lock portion and a regulated portion;

the press-fit portion protrudes from the base portion in the pitch direction and is pressed against the holding portion;

the spring portion extends forward from the base portion and has resilience;

the spring portion is apart from the regulating portions in the pitch direction;

the lock portion is supported by the spring portion and protrudes outward of the mating portion in the pitch direction;

the regulated portion extends forward from the base portion and is situated inward of the regulating portions in the pitch direction; and the lock portion and the mating lock portion lock a mated state of the connector and the mating connector.

2. The connector as recited in claim 1, wherein positions of the regulated portions, positions of the regulating portions and positions of the lock portions are overlapped in the front-rear direction.

3. The connector as recited in claim 1, wherein the flat plate portions have shapes which are mirror symmetrical to each other.

4. The connector as recited in claim 1, wherein the flat plate portions extend in the front-rear direction and the pitch direction.

5. The connector as recited in claim 1, wherein:

the connector further comprises two ground plates; and the ground plates are formed integrally with the flat plate portions by coupling portions, respectively.

6. The connector as recited in claim 5, wherein the coupling portions couple rear ends of the ground plates to rear ends of the flat plate portions, respectively.

7. The connector as recited in claim 5, wherein each integrated combination of the ground plate, the flat plate portion and the coupling portion is made of a metal plate.

8. A connector assembly comprising the connector as recited in claim 1 and the mating connector, wherein:

the lock portion comprises a lock surface, a curved surface portion and a slide surface;

the mating lock portion comprises a mating lock surface, a mating curved surface portion and a mating slide surface;

the lock surface, the curved surface portion and the slide surface are continued in this order;

the mating lock surface, the mating curved surface portion and the mating slide surface are continued in this order;

the lock surface and the slide surface form an obtuse angle inside the lock portion; and the mating lock surface and the mating slide surface form another obtuse angle inside the mating lock portion.

* * * * *